US006155075A

United States Patent [19]

Hanson et al.

[11] Patent Number: 6,155,075

[45] Date of Patent: Dec. 5, 2000

[54] EVAPORATOR WITH ENHANCED REFRIGERANT DISTRIBUTION

[75] Inventors: Oved W. Hanson; Leonard J. Van Essen, both of Carrollton, Tex.

[73] Assignee: Lennox Manufacturing Inc., Richardson, Tex.

[21] Appl. No.: 09/271,680

[22] Filed: Mar. 18, 1999

[51] Int. Cl.[7] ..... F25B 43/00; F25B 39/04

[52] U.S. Cl. ..... 62/512; 62/509; 62/515

[58] Field of Search ..... 62/509, 512, 197, 62/515, 470; 165/175, 173

[56] References Cited

U.S. PATENT DOCUMENTS

| | | | |
|---|---|---|---|
| Re. 35,502 | 5/1997 | Hughes et al. . | |
| 5,172,759 | 12/1992 | Shimoya et al. . | |
| 5,179,845 | 1/1993 | Sasaki et al. . | |
| 5,205,347 | 4/1993 | Hughes . | |
| 5,241,839 | 9/1993 | Hughes | 62/515 |
| 5,242,016 | 9/1993 | Voss et al. . | |
| 5,279,360 | 1/1994 | Hughes et al. . | |
| 5,341,870 | 8/1994 | Hughes et al. . | |
| 5,372,188 | 12/1994 | Dudley et al. . | |
| 5,533,259 | 7/1996 | Hughes et al. . | |
| 5,619,861 | 4/1997 | Yamanaka et al. | 62/512 X |
| 5,735,139 | 4/1998 | Lora et al. | 62/470 |
| 5,771,964 | 6/1998 | Bae . | |
| 5,826,646 | 10/1998 | Bae et al. . | |
| 5,826,649 | 10/1998 | Chapp et al. . | |
| 5,970,732 | 10/1999 | Menin et al. . | |

*Primary Examiner*—William Doerrler
*Assistant Examiner*—Chen-Wen Jiang
*Attorney, Agent, or Firm*—W. Kirk McCord

[57] ABSTRACT

An evaporator for evaporating a phase change refrigerant in a space conditioning system, such as an air conditioner, heat pump or refrigeration system, is provided. The evaporator includes an inlet for introducing the refrigerant into the evaporator, an outlet for discharging the refrigerant from the evaporator and plural conduits defining a plurality of hydraulic flow paths between the inlet and the outlet. In accordance with the invention, a separator is provided to substantially separate liquid refrigerant from vapor refrigerant before the refrigerant is introduced into the evaporator to enhance refrigerant distribution within the evaporator, thereby improving evaporator performance.

21 Claims, 5 Drawing Sheets

EVAPORATOR WITH ENHANCED REFRIGERANT DISTRIBUTION

FIELD OF INVENTION

This invention relates generally to cooling systems, such as air conditioning and refrigeration systems, and in particular to an improved evaporator with enhanced refrigerant distribution.

BACKGROUND ART

In space conditioning systems, such as air conditioners, heat pumps and refrigeration systems, wherein a phase change refrigerant is used as the heat transfer medium, two heat exchangers are typically used, one to substantially evaporate liquid refrigerant to cool an external fluid such as air passing through the evaporator, and the other as a condenser to substantially condense vapor refrigerant by transferring heat to an external fluid passing through the condenser.

Heat exchangers having refrigerant conduits of relatively flat cross-section are known in the art. Such heat exchangers are often referred to as "parallel flow" heat exchangers. In such parallel flow heat exchangers, the interior of each conduit is divided into a plurality of hydraulically parallel flow paths of relatively small hydraulic diameter (e.g., 0.070 inch or less), which are often referred to as "microchannels", to accommodate the flow of heat transfer fluid (e.g., a phase change refrigerant) therethrough. Parallel flow heat exchangers may be of the "tube and fin" type in which tubular conduits are laced through a plurality of heat transfer enhancing fins or of the "serpentine" type in which serpentine fins are coupled between the conduits. The relatively small hydraulic diameter flow paths enhance heat transfer between a fluid such as a phase change refrigerant flowing inside the heat exchanger conduits and an external fluid such as air flowing through the heat exchanger on the outside of the conduits, particularly when the heat exchanger is used as a condenser.

However, when parallel flow heat exchangers are used as evaporators, performance is degraded by the uneven distribution of liquid refrigerant in the various flow paths. This uneven distribution results in some flow paths having too much liquid refrigerant and some having not enough. One approach to solving the aforementioned problem of uneven refrigerant distribution in an evaporator is described in U.S. Pat. No. Re. 35,502. This patent shows an evaporator having an inlet header with two inlets at respective opposed ends thereof to generate streams of incoming liquid refrigerant, which impinge upon one another to dissipate the kinetic energy and/or momentum of the streams, and an outlet header with two outlets at respective opposed ends thereof to generate two streams of outgoing vapor refrigerant, which reduces outlet resistance. The configuration of the inlet and outlet headers results in a more uniform flow of the refrigerant through the evaporator flow paths. Although some improvement in refrigerant distribution is achieved using this approach, uneven distribution of refrigerant still results because of the mixed phase (i.e., liquid and vapor) refrigerant entering the evaporator.

There is, therefore, a need for improved refrigerant distribution among the flow paths of an evaporator and in particular among the flow paths of a "parallel flow" evaporator.

SUMMARY OF THE INVENTION

In accordance with the present invention, an improved evaporator for evaporating a phase change refrigerant by transferring heat to the refrigerant from an external fluid is provided. The evaporator is comprised of inlet means for introducing the refrigerant into the evaporator; outlet means for discharging the refrigerant from the evaporator; plural conduits defining a plurality of hydraulic flow paths between the inlet means and outlet means; and a separator operable to substantially separate liquid refrigerant from vapor refrigerant before the refrigerant is introduced into the evaporator, such that substantially only the liquid refrigerant is introduced into a selected one or more of the conduits.

In accordance with a feature of the invention, the separator has an inlet port through which the refrigerant is able to enter the separator, a first outlet port through which the liquid refrigerant is able to exit the separator and a second outlet port through which the vapor refrigerant is able to exit the separator.

In accordance with another feature of the invention, the inlet means includes an inlet header and the outlet means includes an outlet header. The conduits extend between the inlet header and the outlet header. The inlet header has at least one inlet through which refrigerant is able to enter the evaporator and the outlet header has at least one outlet through which refrigerant is able to exit the evaporator.

In accordance with yet another feature of the invention, a refrigerant expansion device is operably associated with the separator.

In accordance with one embodiment of the invention, bypass means is provided for bypassing the evaporator with the vapor refrigerant. In accordance with another embodiment, the bypass means includes a refrigerant line communicating between the second outlet port of the separator and a suction line of a refrigerant compressor. The bypass line is in heat exchange relationship with a liquid refrigerant line, whereby heat is transferred from the liquid refrigerant to the vapor refrigerant to superheat the vapor refrigerant.

In the preferred embodiment, the evaporator is not bypassed, but rather a baffle is located in the inlet header to divide the inlet header into first and second portions. The first portion is in fluid communication with the first outlet port of the separator for introducing substantially only the liquid refrigerant into the first portion. The second portion is in fluid communication with the second outlet port of the separator, such that substantially only the vapor refrigerant is introduced into the second portion. A first one or more of the conduits communicates with the first portion, such that only liquid refrigerant is introduced into the first one or more of the conduits. A second one or more of the conduits communicates with the second portion, such that substantially only the vapor refrigerant is introduced into the second one or more of the conduits. Also, in the preferred embodiment, the inlet header has only one inlet for introducing refrigerant into the evaporator and the outlet header has two outlets for discharging the refrigerant from the evaporator.

Empirical testing has shown that the evaporator according to the present invention provides substantially increased cooling capacity as compared to prior art evaporators. The pressure drop across the evaporator is also substantially reduced compared to the pressure drop across prior art evaporators. This improvement in performance is believed to be due to better distribution of the refrigerant among the hydraulically parallel flow paths of the evaporator, which is achieved by substantially separating the liquid refrigerant from the vapor refrigerant before the refrigerant enters the evaporator. The present invention is particularly advantageous in improving refrigerant distribution among the flow paths in "parallel flow" evaporators.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more clearly depict certain features of the invention.

Figure 1:
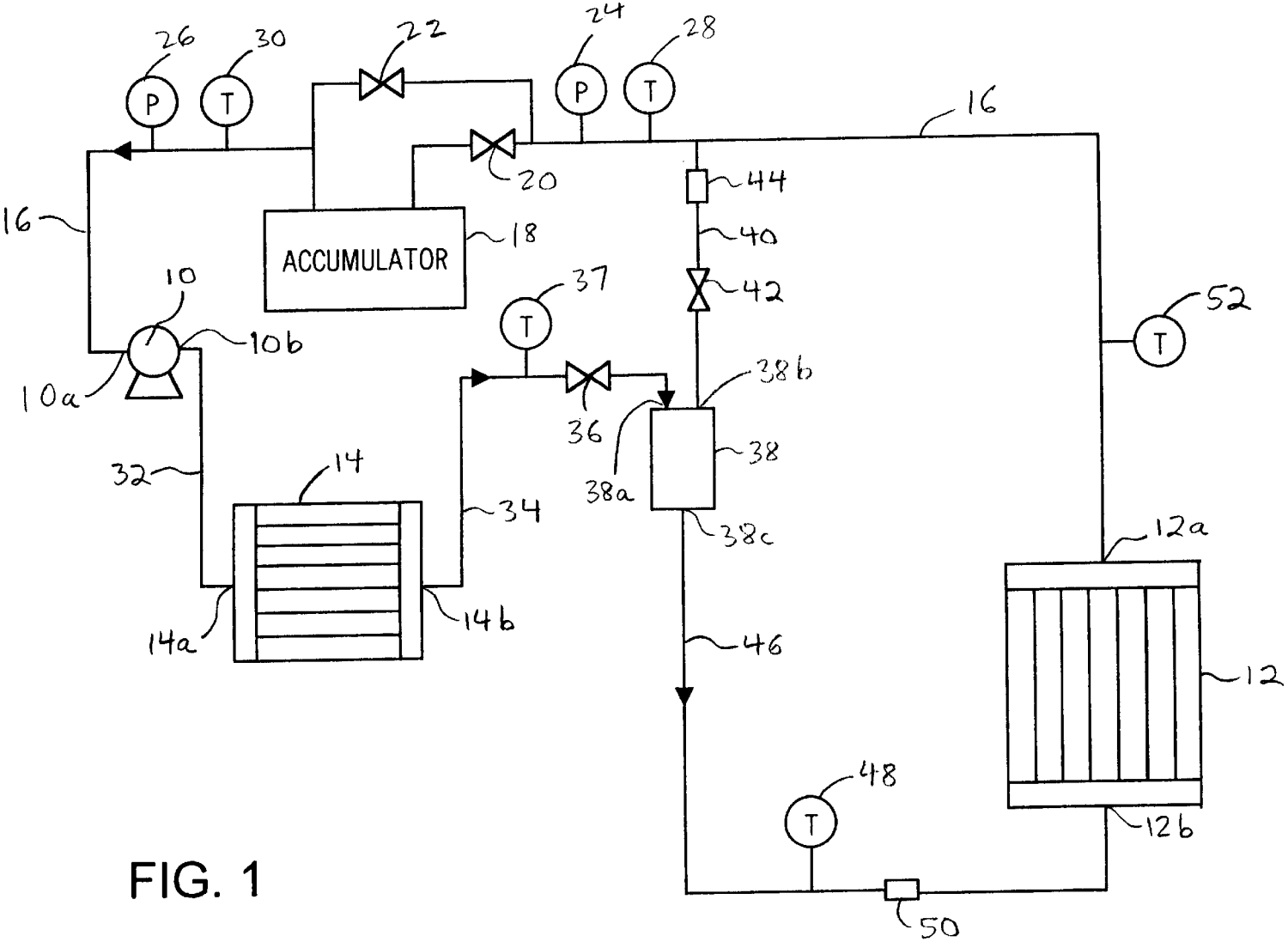
FIG. 1 is a schematic of a space conditioning system, according to the present invention.

Referring to FIG. 1, a space conditioning system of the type in which a phase change refrigerant is used to temperature condition an external fluid, such as air in a conditioned space, is depicted. The system includes a refrigerant compressor 10, which is operable to circulate refrigerant between two heat exchangers 12 and 14. By way of example and not limitation, the space conditioning system will hereinafter be described with reference to an air conditioning system, with heat exchanger 12 being hereinafter referred to as evaporator 12 and heat exchanger 14 being hereinafter referred to as condenser 14. One skilled in the art will recognize that the space conditioning system depicted in FIG. 1 could be a heat pump system or a refrigeration system in lieu of an air conditioning system.

A suction line 16 communicates between an outlet 12*a* of evaporator 12 and a suction side 10*a* of compressor 10. An accumulator 18 is located in suction line 16 to capture liquid refrigerant from suction line 16 before the refrigerant reaches suction side 10*a*. Valves 20 and 22 are operable to help capture the liquid refrigerant, while allowing the vapor refrigerant to substantially bypass accumulator 18. Pressure sensors 24, 26 and temperature sensors 28, 30 are also located in suction line 16. Pressure sensor 24 and temperature sensor 28 are between evaporator 12 and accumulator 18, and pressure sensor 26 and temperature sensor 30 are between accumulator 18 and compressor 10.

Compressor 10 increases the temperature and pressure of the vapor refrigerant, such that the vapor refrigerant on a discharge side 10*b* of compressor 10 is at a higher pressure and temperature than the vapor refrigerant on suction side 10*a*. Compressor 10 discharges vapor refrigerant through discharge line 32 to a suction side 14*a* of condenser 14. The vapor refrigerant is substantially condensed in condenser 14 and is discharged therefrom substantially as liquid refrigerant in liquid line 34. A thermal expansion device 36 (preferably a thermal expansion valve) is located in liquid line 34 between condenser 14 and evaporator 12. A temperature sensor 37 is also located in line 34 to measure the temperature of the liquid refrigerant therein.

In accordance with the present invention, a separator 38 is also located in liquid line 34, between expansion device 36 and an inlet 12*b* of evaporator 12. Separator 38, which will be described in greater detail hereinafter, has a single inlet port 38*a* and two outlet ports 38*b*, 38*c*. Separator 38 is oriented vertically, such that outlet port 38*b* is at the top of separator 38 and outlet port 38*c* is at the bottom thereof. Liquid line 34 extends between a discharge side 14*b* of condenser 14 and inlet port 38*a* of separator 38. In operation, expansion of the liquid refrigerant as it passes through expansion device 36 results in mixed phase (i.e., both liquid and vapor) refrigerant entering separator 38 through inlet port 38*a*. The liquid and vapor refrigerant are substantially separated within separator 38, such that the lighter vapor refrigerant rises within separator 38 and is able to escape therefrom through top outlet port 38*b*, and the heavier liquid refrigerant falls within separator 38 and is able to escape therefrom through bottom outlet port 38*c*. A bypass line 40 communicates between top outlet port 38*b* and suction line 16, such that the vapor refrigerant exiting separator 38 through top outlet port 38*b* escapes into suction line 16 and bypasses evaporator 12. A bypass valve 42 and a sight glass 44 are located in bypass line 40. Bypass valve 42 is used to control the flow of vapor refrigerant through bypass line 40 and site glass 44 is used to visually determine whether liquid refrigerant is also escaping through bypass line 40.

An evaporator feed line 46 communicates between bottom outlet port 38*c* and evaporator inlet 12*b*. A temperature sensor 48 and a sight glass 50 are located in feed line 46. Temperature sensor 48 cooperates with another temperature sensor 52 in suction line 16 to control the superheat across evaporator 12. Sight glass 50 is used to visually determine whether substantially only liquid refrigerant is entering evaporator 12. The pressure differential between suction line 16 and feed line 46 provided by the operation of compressor 10 not only circulates the refrigerant throughout the system, but also draws the vapor refrigerant through bypass line 40 into suction line 16.

Evaporator 12 substantially evaporates the liquid refrigerant so that refrigerant in a substantially vapor state exits evaporator 12 through outlet 12*a* into suction line 16. By substantially separating the liquid refrigerant from the vapor refrigerant before the refrigerant enters evaporator 12, evaporator performance is substantially improved, not only in terms of increased cooling capacity, but also in terms of reduced pressure drop across evaporator 12. It is believed that this improved performance is due to better distribution of the refrigerant throughout the hydraulic flow paths of evaporator 12.

Figure 2:
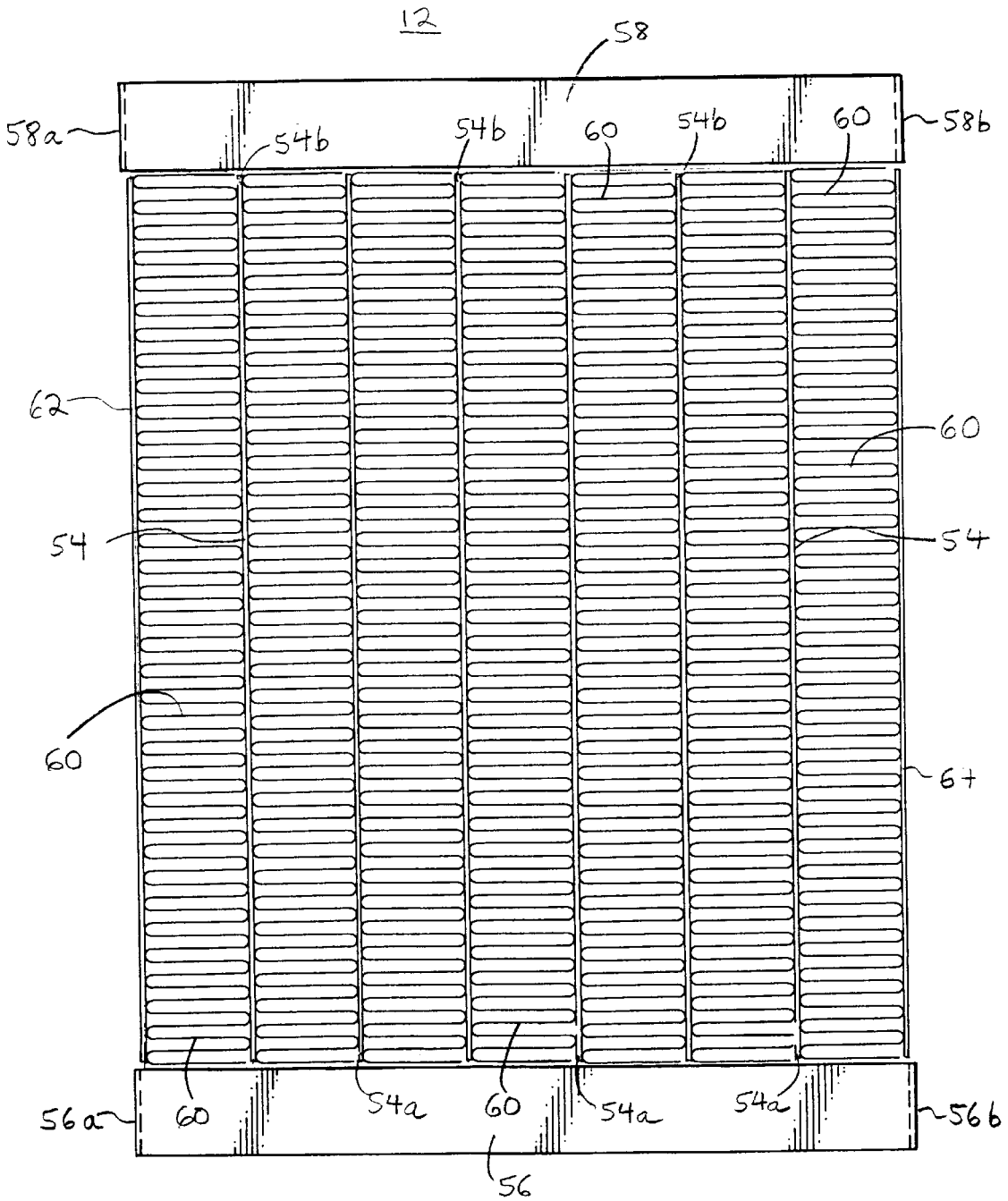
FIG. 2 is a side elevation view of a flat-tubed heat exchanger included in the system of FIG. 1.

Referring to FIG. 2, in the preferred embodiment, evaporator 12 is a heat exchanger of the "parallel flow" type, comprised of a plurality of elongated, substantially vertically oriented tubes 54 of non-circular cross-section extending between opposed inlet and outlet headers 56 and 58, respectively, which are oriented substantially horizontally. Tubes 54 are preferably made of metal, such as aluminum or copper. Tubes 54 extend through complementary slots (not shown) in inlet and outlet headers 56 and 58. Inlet header 56 has end caps 56*a*, 56*b* to close off the ends thereof. Outlet header 58 has end caps 58*a*, 58*b* to close off the ends thereof. A plurality of heat transfer enhancing, serpentine fins 60 extend between and are bonded, for example, by brazing, to adjacent ones of tubes 54 and are supported thereby. Fins 60 are preferably made of metal, such as aluminum or copper. Evaporator 12 further includes side plates 62, 64. The fins 60 which are proximate to side plates 62, 64 are bonded to the corresponding side plates 62, 64 and to the respective adjacent tubes 54.

Each tube 54 has an inlet (not shown) at one end 54*a* thereof and an outlet (not shown) at an opposite end 54*b* thereof. The inlet of each tube 54 at end 54*a* thereof is in fluid communication with inlet header 56 and the outlet of each tube 54 at end 54*b* thereof is in fluid communication with outlet header 58, whereby the refrigerant is able to flow from inlet header 56 through the inlet of each tube 54 into the corresponding tube 54 and is able to flow out of each tube 54 through the outlet thereof into outlet header 58.

Although not shown in the drawings, each tube 54 has a plurality of hydraulically parallel flow paths of relatively small hydraulic diameter (e.g., 0.070 inch or less) extending along a major dimension of the corresponding tube 54. Although not shown in the drawings, condenser 14 has essentially the same configuration as evaporator 12, except that in condenser 14 the inlet and outlet headers are oriented substantially vertically and the refrigerant carrying tubes run substantially horizontally between the inlet and outlet headers.

Figure 3:
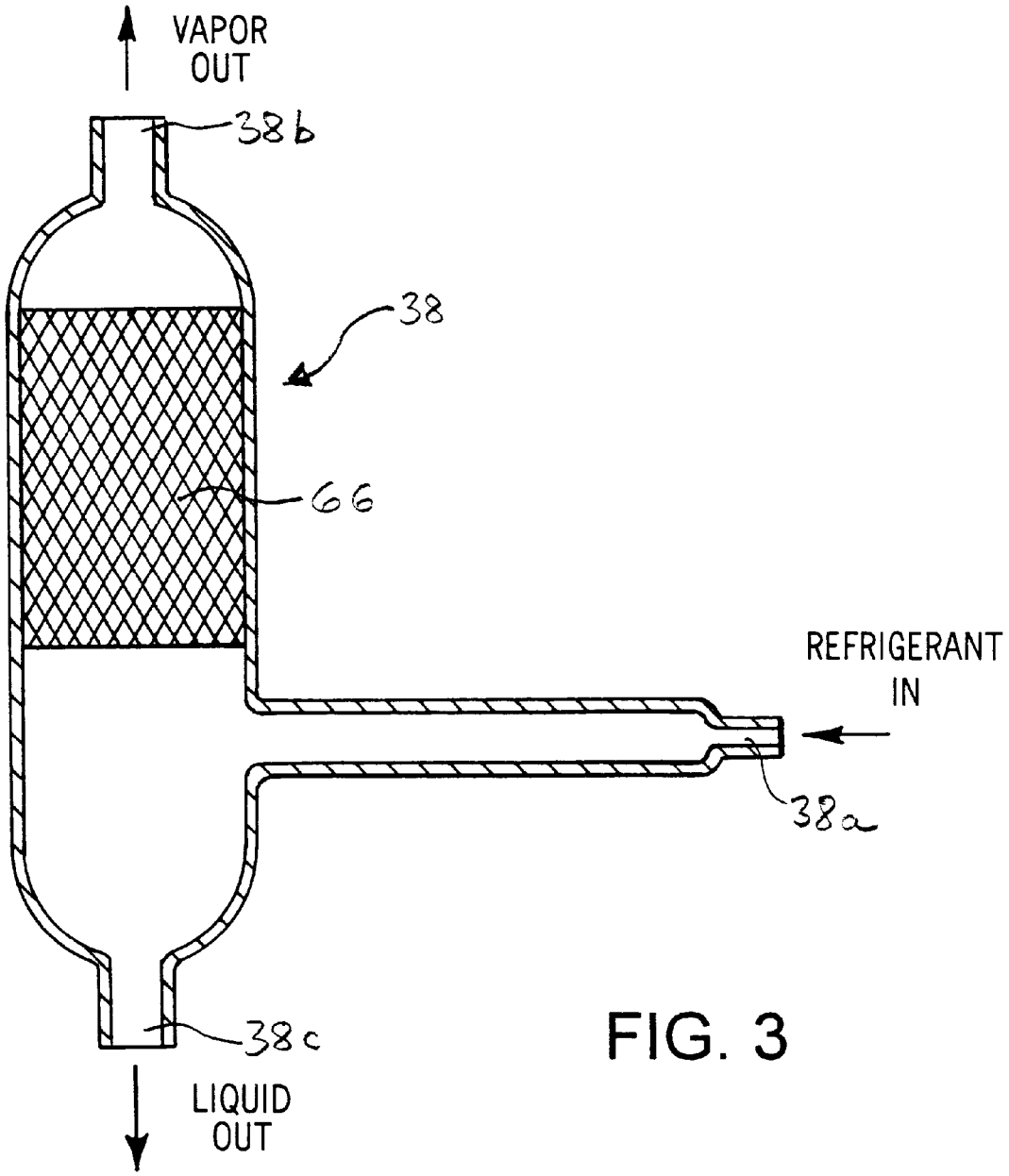
FIG. 3 is a partial cutaway, elevation view of a separator included in the system of FIG. 1, according to the present invention.

Referring now to FIG. 3, separator 38 is generally cylindrically-shaped, with its major dimension oriented vertically. Located inside of separator 38 is a medium for separating the liquid and vapor refrigerant. In the preferred embodiment, the separating medium is a wire mesh 66. Mesh 66 has a substantially greater resistance (i.e., pressure drop) to the flow of the liquid refrigerant than to the flow of the vapor refrigerant, which effectively separates the liquid refrigerant from the vapor refrigerant. Mesh 66 is located in the upper half of separator 38, such that the lowermost portion of mesh 66 lies above inlet port 38*a*. As such, mesh 66 effectively blocks the heavier liquid refrigerant, while allowing the lighter vapor refrigerant to rise through mesh 66.

In the preferred embodiment, separator 38 has a length along its major dimension of approximately 7¾ inches, including outlet ports 38*b*, 38*c*. Mesh 66 extends along the major dimension of separator 38 approximately 1⅝ inches. The uppermost part of the mesh is approximately 1¾ inch below top outlet port 38*b*. Inlet port 38*a* has a diameter of approximately ¾ inch and outlet ports 38*b*, 38*c* each have a diameter of about ⅜ inch. Separator 38 has a diameter of approximately two inches.

In lieu of the mesh-type separator described hereinabove, another type of separator can be used. For example, in an alternate embodiment, a cyclonic-type separator may be used. In another alternate embodiment, a porous membrane-type separator may be used.

Figure 4B:
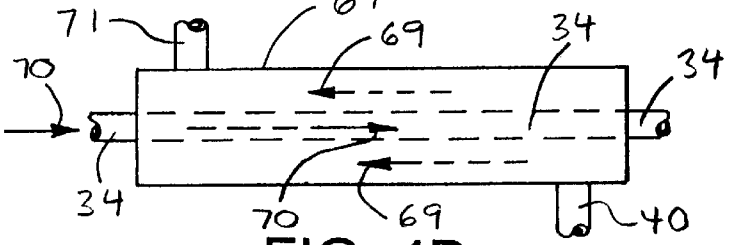
FIG. 4B is a side elevation view of a heat exchanger included in the system of FIG. 4A.
Figure 5:
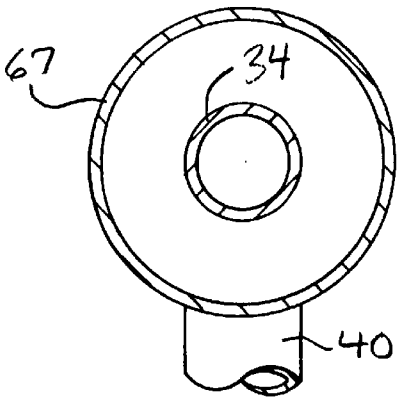
FIG. 5 is a sectional view, taken along the line 5—5 in FIG. 4A.
Figure 4A:
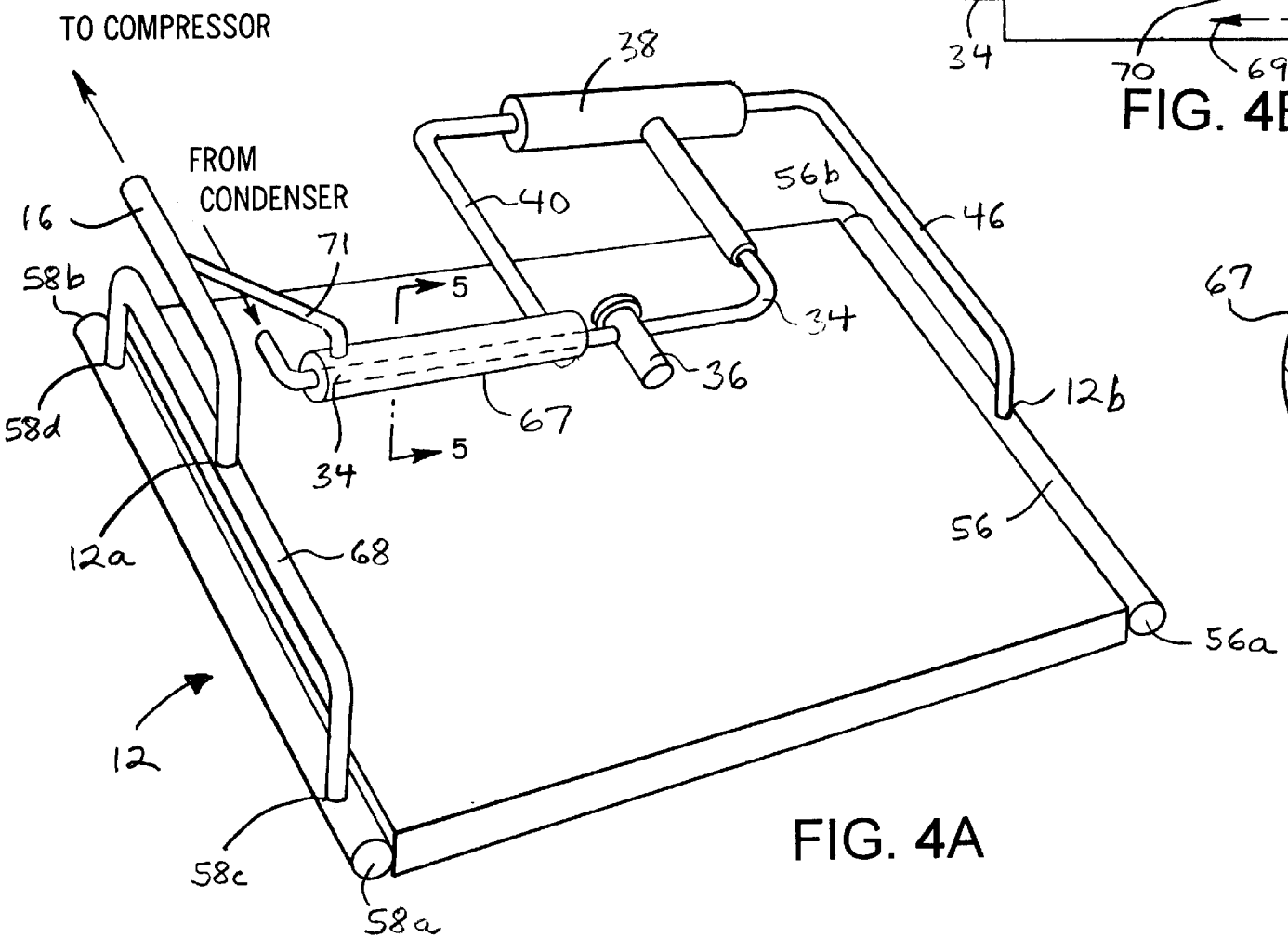
FIG. 4A is a partial schematic of an alternate embodiment of a space conditioning system, according to the present invention.

Referring to FIGS. 4A, 4B and 5, in accordance with an alternate embodiment of the invention, a generally cylindrical sleeve 67 is disposed in co-axial heat exchange relationship with a portion of liquid line 34, between condenser 14 and expansion device 36. Bypass line 40 is in fluid communication with the interior of sleeve 67 to introduce vapor refrigerant into sleeve 67. As can be best seen in FIG. 5, vapor refrigerant flows in the direction of arrows 69 within sleeve 67, in counterflow relationship to the direction of flow of liquid refrigerant within line 34, as indicated by arrows 70. The vapor refrigerant is superheated by the liquid refrigerant in line 34 and the liquid refrigerant is subcooled by the vapor refrigerant flowing around line 34, thereby resulting in more stable operation of expansion device 36 over a wide range of refrigerant flow rates. The vapor refrigerant escapes from sleeve 67 through a vapor line 71, which communicates between sleeve 67 and suction line 16.

Inlet 12*b* of evaporator 12 is located approximately equidistant between opposed ends 56*a*, 56*b* of inlet header 56. An outlet manifold 68 is interposed between outlet header 58 and suction line 16. Outlet header 58 has two outlets 58*c*, 58*d* proximate to opposed ends 58*a*, 58*b*, respectively. Outlets 58*c*, 58*d* feed into outlet manifold 68 at respective opposed ends thereof. Evaporator outlet 12*a* is located approximately equidistant between respective opposed ends of outlet manifold 68. By empirical testing, it has been determined that evaporator performance is enhanced by having a single inlet into inlet header 56 and one or two outlets from outlet header 58.

Figure 6:
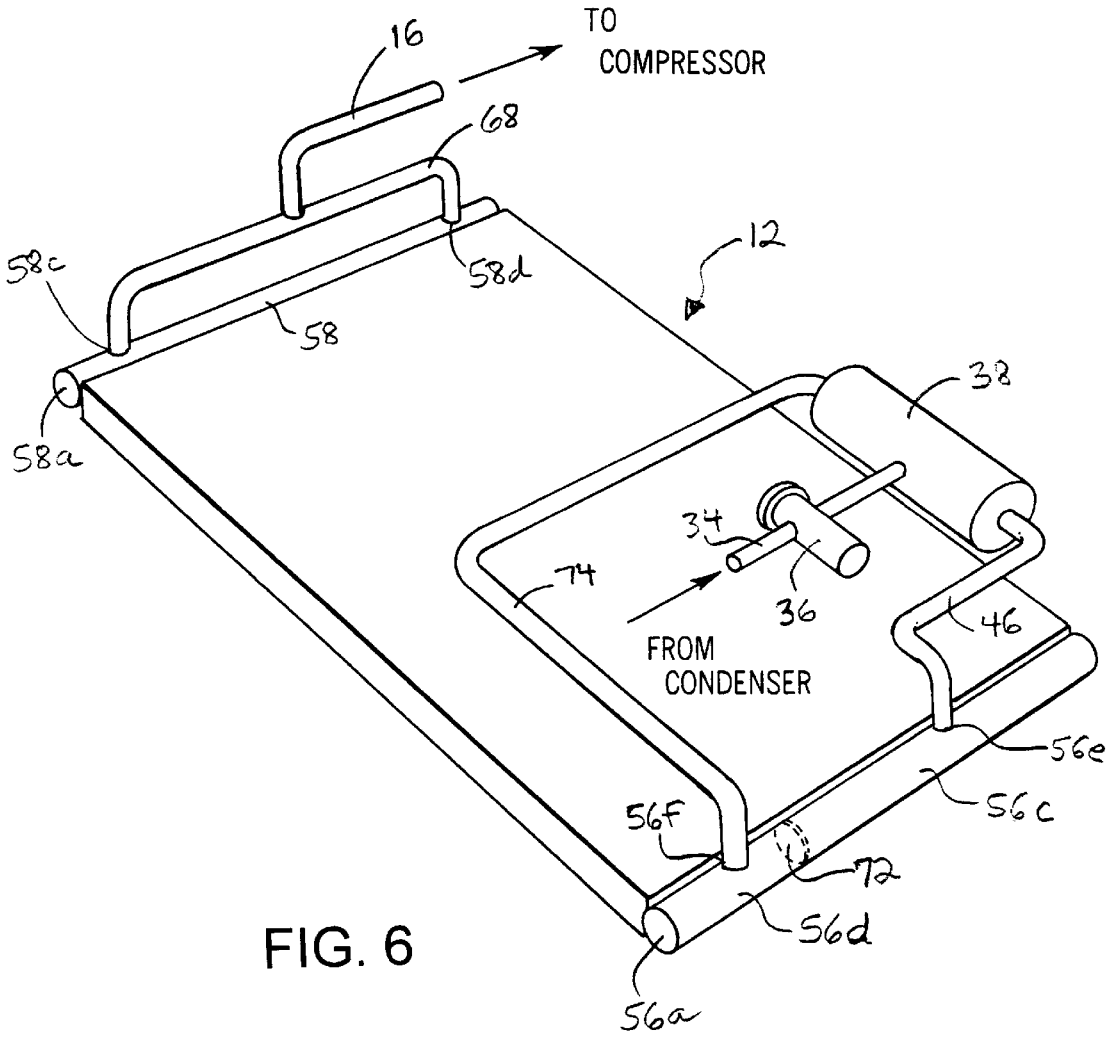
FIG. 6 is a partial schematic of another alternate embodiment of a space conditioning system, according to the present invention.

Referring now to FIG. 6, in accordance with another alternate embodiment of the invention, the vapor refrigerant does not bypass evaporator 12, as in the embodiments previously described. Rather, the liquid refrigerant is fed into a first portion 56*c* of inlet header 56 and the vapor refrigerant is fed into a second portion 56*d* of inlet header 56 after the liquid and vapor refrigerant are substantially separated by separator 38. A baffle 72 is located in inlet header 56, between ends 56*a* and 56*b* of inlet header 56 and preferably closer to end 56*a*. Instead of a single evaporator inlet 12*b*, as previously described, evaporator 12 has two inlets 56*e*, 56*f* in this configuration. The liquid refrigerant is fed into first portion 56*c* of inlet header 56 through inlet 56*e* via liquid feed line 46 and the vapor refrigerant is fed via a vapor feed line 74 into second portion 56*d* through inlet 56*f*. The particular tubes 54 extending between first portion 56*c* and outlet header 58 receive substantially only the liquid refrigerant, while the particular tubes 54 which extend between second portion 56*d* of inlet header 56 and outlet header 58 receive substantially only the vapor refrigerant. This approach eliminates the need for the extra hardware associated with the above-described "bypass" approach and provides essentially the same advantages.

Empirical testing has shown that the evaporator according to the present invention provides substantially increased cooling capacity as compared to prior art evaporators and in particular as compared to prior art "parallel flow" evaporators. The pressure drop across the evaporator is also substantially reduced compared to the pressure drop across prior art evaporators. This improvement in performance is believed to be due to better distribution of the refrigerant among the hydraulic flow paths of the evaporator, which is achieved by substantially separating the liquid refrigerant from the vapor refrigerant before the refrigerant enters the evaporator.

What is claimed is:

1. In combination:

an evaporator for evaporating a phase change refrigerant by transferring heat to the refrigerant from an external fluid, said evaporator having inlet means for introducing the refrigerant into said evaporator, outlet means for discharging the refrigerant from said evaporator, and plural conduits extending between said inlet means and said outlet means and defining a plurality of hydraulic flow paths to accommodate refrigerant flow therethrough;

a separator operable to substantially separate liquid refrigerant from vapor refrigerant before the refrigerant is introduced into said evaporator, such that substantially only the liquid refrigerant is introduced into at least a portion of said evaporator, said separator having an inlet port and first and second outlet ports;

a first refrigerant line communicating with said inlet port for introducing the refrigerant into said separator;

a second refrigerant line communicating between said first outlet port and said inlet means for introducing the liquid refrigerant separated from the vapor refrigerant in said separator into said evaporator; and a bypass line communicating with said second outlet port for substantially bypassing said evaporator with the vapor refrigerant separated from the liquid refrigerant in said separator, at least a portion of said bypass line being in heat exchange relationship with at least a portion of said first refrigerant line, whereby the vapor refrigerant which bypasses said evaporator is superheated by the refrigerant in said first refrigerant line.

2. The combination of claim 1 wherein the vapor refrigerant flowing in said at least a portion of said bypass line is in counterflow relationship to the refrigerant flowing in said at least a portion of said first refrigerant line.

3. The combination of claim 2 wherein said at least a portion of said bypass line includes an elongated sleeve co-axially disposed about said at least a portion of said first refrigerant line, said sleeve having an inlet opening proximate to one end of said sleeve and an outlet opening proximate to an opposite end of said sleeve from said one end thereof, said inlet opening being adapted to receive the vapor refrigerant discharged from said separator and said outlet opening being adapted to discharge the vapor refrigerant from said sleeve, said inlet and outlet openings being spaced apart to provide a flow of the vapor refrigerant in said openings being spaced apart to provide a flow of the vapor refrigerant in said sleeve in counterflow relationship to the flow of the refrigerant in said first refrigerant line.

4. The combination of claim 1 further including a refrigerant expansion device in said first refrigerant line between said separator said at least a portion of said first refrigerant line, such that said at least a portion of said first refrigerant line is in heat exchange relationship with said at least a portion of said bypass line upstream of said separator and said expansion device.

5. The combination of claim 4 wherein said separator is intermediate said expansion device and said evaporator, such that said expansion device is upstream of said separator and said separator is operable to substantially separate the liquid refrigerant from the vapor refrigerant after the refrigerant passes through said expansion device, said combination further including a condenser for substantially condensing the refrigerant evaporated by said evaporator and a compressor for circulating the refrigerant between said evaporator and said condenser.

6. The combination of claim 1 wherein said separator has an internal mesh with substantially greater resistance to passage of liquid refrigerant than vapor refrigerant, said mesh being located between said first and second outlet ports.

7. The combination of claim 1 wherein said separator has only one inlet port.

8. The combination of claim 1 wherein said inlet means includes an inlet header at one end of said evaporator and said outlet means includes an outlet header at an opposite end of said evaporator from said inlet header, said outlet header having plural outlets through which the refrigerant is able to exit said evaporator.

9. The combination of claim 8 wherein said inlet header has only one inlet through which the refrigerant is able to enter said evaporator and said outlet header has only two outlets through which the refrigerant is able to exit said evaporator.

10. The combination of claim 9 wherein said outlet header is an elongated header having opposed first and second ends, said two outlets being proximate to said first and second ends, respectively.

11. The combination of claim 9 wherein said inlet header is an elongated header having opposed first and second ends, said inlet being approximately equidistant between said first and second ends, respectively.

12. The combination of claim 11 wherein said outlet header is an elongated header having opposed ends, said two outlets being proximate to said opposed ends of said outlet header, respectively.

13. In combination:

an evaporator for evaporating a phase change refrigerant by transferring heat to the refrigerant from an external fluid, said evaporator having inlet means for introducing the refrigerant into said evaporator, outlet means for discharging the refrigerant from said evaporator, and plural conduits extending between said inlet means and said outlet means and defining a plurality of hydraulic flow paths to accommodate refrigerant flow therethrough; and a separator operable to substantially separate liquid refrigerant from vapor refrigerant before the refrigerant is introduced into said evaporator, such that substantially only the liquid refrigerant is introduced into at least a portion of said evaporator, said separator having an internal mesh with substantially greater resistance to passage of liquid refrigerant than vapor refrigerant, said separator having an inlet port through which the refrigerant is able to enter said separator, a first outlet port through which the liquid refrigerant is able to exit said separator and a second outlet port through which the vapor refrigerant is able to exit said separator, said mesh being located between said first and second outlet ports.

14. The combination of claim 13 further including a refrigerant expansion device, said separator being intermediate said expansion device and said evaporator.

15. The combination of claim 14 further including a condenser for substantially condensing the refrigerant evaporated by said evaporator and a compressor for circulating the refrigerant between said evaporator and said condenser.

16. The combination of claim 13 wherein said separator has only one inlet port.

17. The combination of claim 16 wherein said inlet means includes an inlet header at one end of said evaporator and said outlet means includes an outlet header at an opposite end of said evaporator from said inlet header, said outlet header having plural outlets through which the refrigerant is able to exit said evaporator.

18. The combination of claim 17 wherein said inlet header has only one inlet through which the refrigerant is able to enter said evaporator and said outlet header has only two outlets through which the refrigerant is able to exit said evaporator.

19. The combination of claim 18 wherein said outlet header is an elongated header having opposed first and second ends, said two outlets being proximate to said first and second ends, respectively.

20. The combination of claim 18 wherein said inlet header is an elongated header having opposed first and second ends, said inlet being approximately equidistant between said first and second ends, respectively.

21. The combination of claim 20 wherein said outlet header is an elongated header having opposed ends, said two outlets being proximate to said opposed ends of said outlet header, respectively.

* * * * *